US008322697B2

(12) United States Patent
Lin

(10) Patent No.: US 8,322,697 B2
(45) Date of Patent: Dec. 4, 2012

(54) CLAMPING DEVICE FOR ADJOINING BOARD MATERIALS

(75) Inventor: Freddy Lin, Taichung Hsien (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 287 days.

(21) Appl. No.: 12/882,321

(22) Filed: Sep. 15, 2010

(65) Prior Publication Data

US 2011/0248436 A1 Oct. 13, 2011

(30) Foreign Application Priority Data

Apr. 9, 2010 (TW) ..... 99111144 A

(51) Int. Cl.

| | |
|---|---|
| ***B25B 1/00*** | (2006.01) |
| ***B25B 1/20*** | (2006.01) |
| ***B25B 1/02*** | (2006.01) |
| ***B25B 1/10*** | (2006.01) |
| ***B25B 5/00*** | (2006.01) |

(52) U.S. Cl. ..... 269/42; 269/3; 269/6; 269/154; 269/249; 269/143

(58) Field of Classification Search ..... 269/3, 6, 269/154, 143, 249, 42; 29/257, 276; D8/73; 248/228.6, 231.71, 228.3, 231.41, 229.22, 248/229.25, 229.12, 229.15, 316.4, 227.1, 248/227.2; 81/487

See application file for complete search history.

(56) References Cited

U.S. PATENT DOCUMENTS

| | | | | |
|---|---|---|---|---|
| 4,691,907 | A * | 9/1987 | Yang | 269/152 |
| 4,979,273 | A * | 12/1990 | Friedrickson et al. | 269/249 |
| 6,213,369 | B1 * | 4/2001 | Kato | 226/162 |
| 7,472,493 | B2 * | 1/2009 | Schmier et al. | 269/143 |
| 7,891,618 | B2 * | 2/2011 | Carnevali | 269/143 |

* cited by examiner

*Primary Examiner* — Monica Carter
*Assistant Examiner* — Seahee Yoon
(74) *Attorney, Agent, or Firm* — Guice Patents PLLC

(57) ABSTRACT

A clamping device for adjoining board materials includes: a C-shaped base having a base section, a top arm and an upright arm; a first press rod and a second press rod vertically movably fitted through the top arm; two first fastener assemblies for fastening and locating the press rods; a horizontal holder mechanism fitted on the first press rod and vertically movable along the first press rod; and a second fastener assembly for adjustably fastening the holder mechanism to the first press rod at a height. The holder mechanism includes at least one horizontally movable guide pin and an abutment member disposed at a front end of the guide pin. In use, a horizontal board material and an upright board material are placed in the base and fixedly held with the first and second press rods respectively. The abutment member serves to abut against and hold the upright board material.

19 Claims, 12 Drawing Sheets

CLAMPING DEVICE FOR ADJOINING BOARD MATERIALS

BACKGROUND OF THE INVENTION

1. Field of the Invention

The present invention relates generally to a mechanical apparatus, and more particularly to a clamping device for clamping board materials.

2. Description of the Related Art

In the manufacturing of products of stone materials, it is often necessary to adjoin two slates by an angle of 90 degrees. An adhesive is first applied to the junctures of the board materials and then the board materials are clamped and fixed with a clamping device. After the adhesive is hardened, the board materials are fixedly adjoined with each other.

Conventionally, the slates are clamped by means of a C-shaped clamp. FIG. 1 shows a commercially available clamping device 10. The clamping device 10 has a base 12 for resting a horizontal slate 14 and an upright slate 16 thereon. The clamping device 10 further has a first clamping rod 17 and a second clamping rod 18, which are identically to each other in structure. The first and second clamping rods 17, 18 vertically pass through the base 12 and are up and down movable. Each of the clamping rods 17, 18 includes an outer tube 19 and a threaded rod 20 screwed in the outer tube 19. An outer circumference of the outer tube 19 is formed with multiple annular grooves 191. A rotary button 21 is disposed at a top end of the threaded rod 20 and a clamp head 22 is disposed at a bottom end of the threaded rod 20. The clamping device 10 further has a first engaging plate 23 and a second engaging plate 24. Each of the engaging plates 23, 24 has a fixed end, a free end and a through hole (not shown). The fixed ends of the engaging plates 23, 24 are inserted in a raised section 121 disposed on a top face of the base 12. The clamping rods 17, 18 pass through the through holes of the engaging plates 23, 24. The engaging plates 23, 24 are respectively lifted by two springs 25 to keep the free ends of the engaging plates 23, 24 upward biased. The clamping device 10 further has a cantilever 26 pivotally disposed on one side of the base 12. The cantilever 26 is slidable along a guide slot 27 for adjusting the height.

In use, taking the first engaging plate 23 and the first clamping rod 17 as an example, when the first engaging plate 23 is biased, an edge of the through hole of the first engaging plate 23 is engaged in one of the annular grooves 191 of the outer circumference of the outer tube 19. Under such circumstance, the clamping rod 17 is chucked with the engaging plate 23 and hindered from sliding upward. Then the rotary button 21 is rotated to lower the threaded rod 20 and fix the horizontal slate 14 with the clamp head 22 at the bottom end of the clamping rod 17. When the free end of the engaging plate 23 is pressed down, the outer circumference of the outer tube 19 of the clamping rod 17 is no longer chucked with the engaging plate 23. At this time, a user can move the clamping rod 17 upward to release the slate 14. Similarly, the upright slate 16 can be clamped by means of the second clamping rod 18 or released therefrom. The cantilever 26 serves to hook a top end of the upright slate 16 to keep the slate 16 upright. The slates 14, 16 are clamped with the clamping device 10, whereby the junctions of the slates 14, 16 can be adhered to each other.

The above clamping device 10 is better than a conventional C-shaped clamp, however, such clamping device 10 still has some defects that need to be overcome as follows:

First, the cantilever 26 of the clamping device 10 serves to enhance the stability of the upright slate 16. However, the cantilever 26 simply contacts with the top edge of the slate without supporting the slate in any other position.

Second, when clamping the slate, the engaging plate 23 is engaged in a most suitable annular groove 191 of the outer tube 19 of the clamping rod 17 to space the clamp head 22 from the horizontal slate 14 by a shortest gap. Then the threaded rod 20 is rotated to lower the clamp head 22 for clamping the slate 14. The second clamping rod 18 is operated in the same manner. Such process is still quite time-consuming so that the slates can be hardly quickly clamped.

SUMMARY OF THE INVENTION

It is therefore a primary object of the present invention to provide a clamping device, which is able to quickly clamp a horizontal board material and an upright board material for adjoining the board materials and release the board materials after adjoined.

It is a further object of the present invention to provide the above clamping device, which includes a horizontal holder mechanism. The horizontal holder mechanism serves to adjustably abut against the upright board material at a suitable height so as to more securely hold the upright board material.

The present invention can be best understood through the following description and accompanying drawings, wherein:

DETAILED DESCRIPTION OF THE PREFERRED EMBODIMENT

Figure 1:
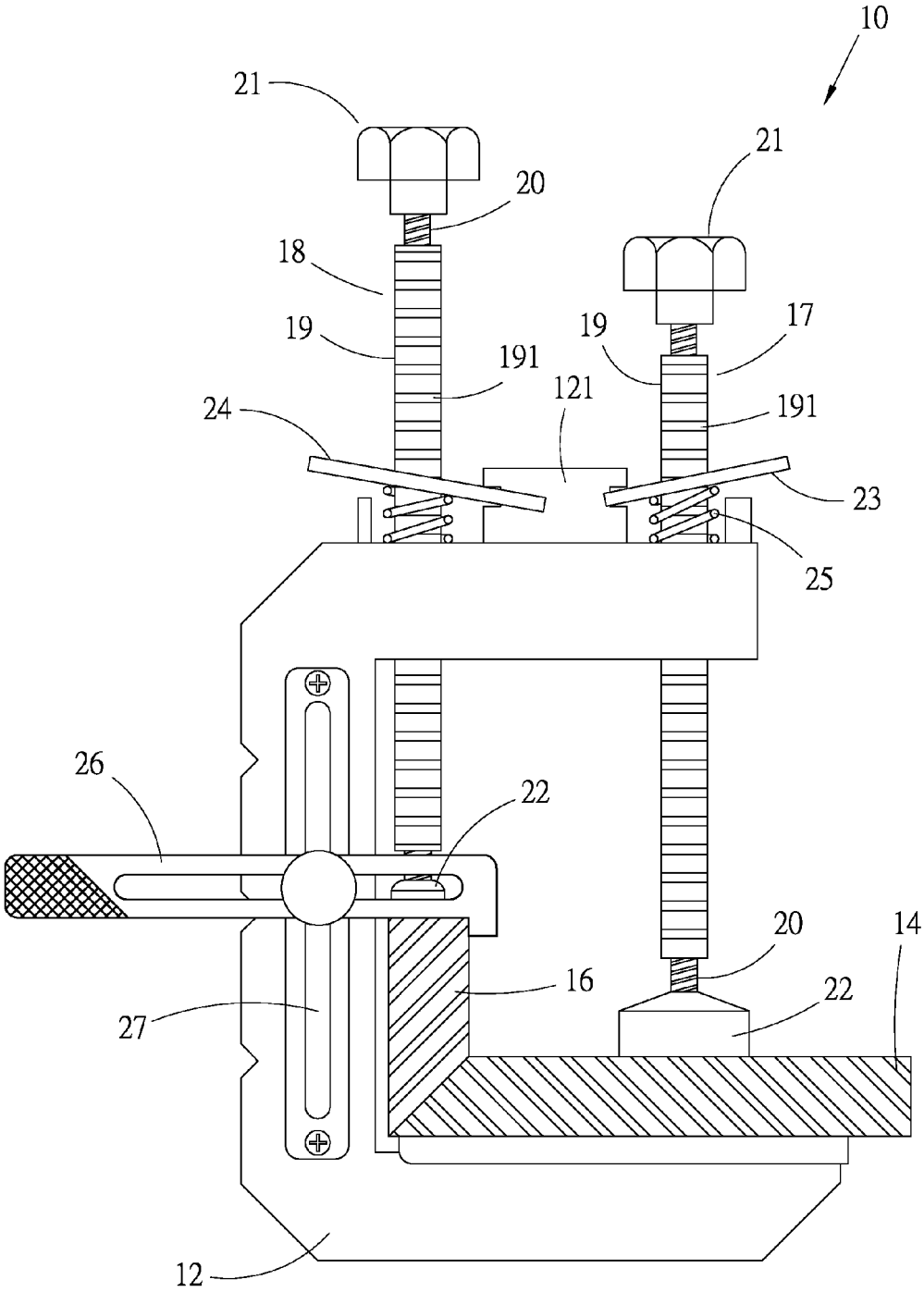
Fig. 1 PRIOR ART
FIG. 1 is a front view of a conventional clamping device.
Figure 2:
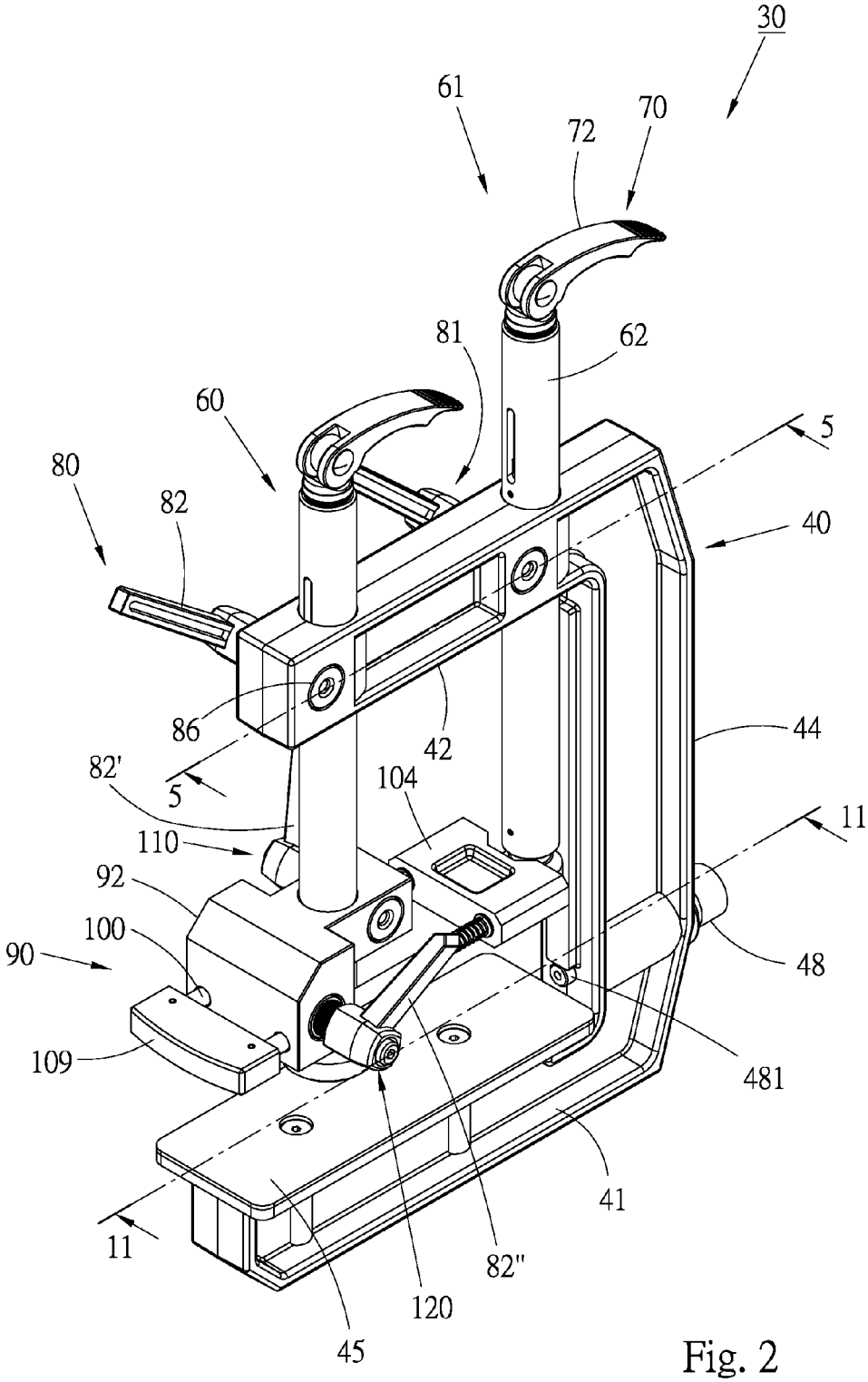
FIG. 2 is a perspective assembled view of a preferred embodiment of the present invention.
Figure 3:
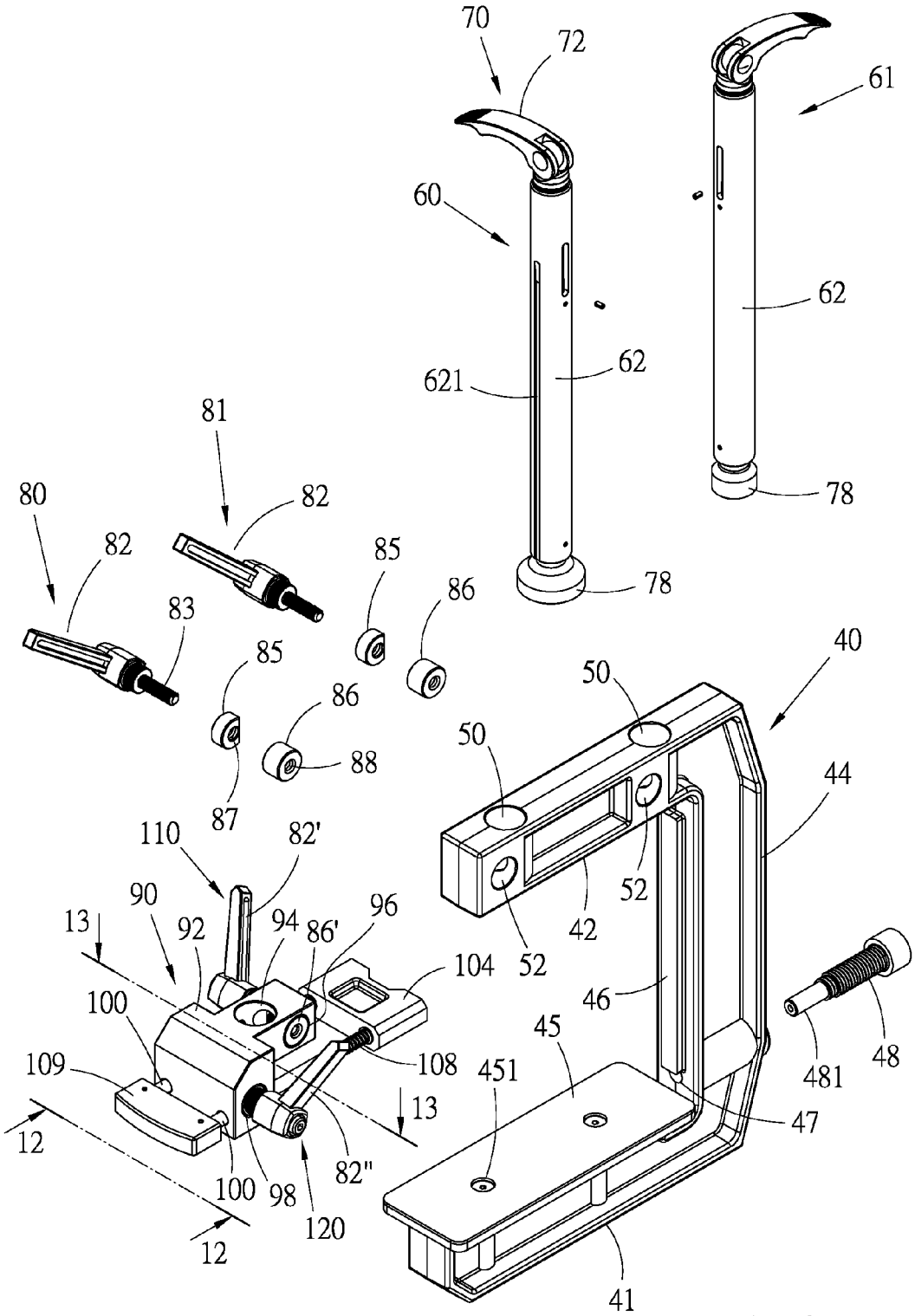
FIG. 3 is a perspective general exploded view of the preferred embodiment of the present invention according to FIG. 2.
Figure 4:
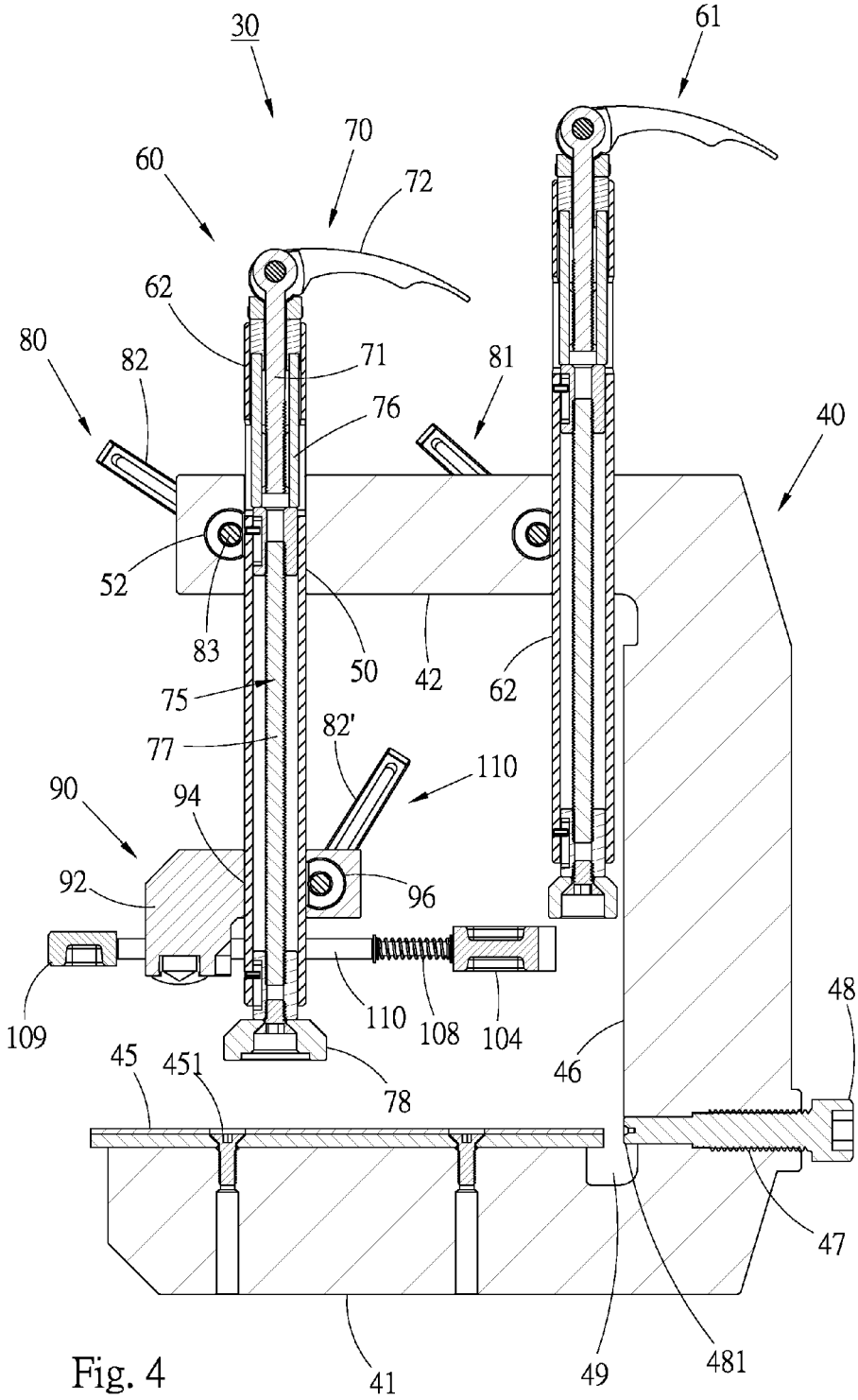
FIG. 4 is a longitudinally sectional view according to FIG. 2.

Please refer to FIGS. 2 to 4. According to a preferred embodiment, the clamping device 30 of the present invention is used to clamp board materials such as slates or wooden boards. The clamping device 30 includes a base 40, a first press rod 60, a second press rod 61, two first fastener assemblies 80, 81, a horizontal holder mechanism 90, and a second fastener assembly 110 and a third fastener assembly 120 mounted on the horizontal holder mechanism 90.

The base 40 is C-shaped, having a horizontal base section 41, a top arm 42 and an upright arm 44 connected between the base section 41 and the top arm 42. The base section 41, the top arm 42 and the upright arm 44 define therebetween a space for resting board materials therein. A bottom board 45 is mounted to a top face of the base section 41 by means of threaded members 451 for enlarging contact area between the base 40 and a horizontal board material. A vertical standard face 46 is disposed on an inner side of the upright arm 44 for attaching an upright board material thereto. A threaded hole 47 is formed through the upright arm 44 from an outer side to the inner side of the upright arm 44. The threaded hole 47 has an inner end positioned right under the standard face 46. A standard bolt 48 is screwed through the threaded hole 47, an inner end 481 of the bolt 48 may protrudes from the inner side of the upright arm 44 in flush with the standard face 46. A recess 49 is formed at a juncture between the upright arm 44 and the base section 41 as shown in FIG. 4.

Figure 5:
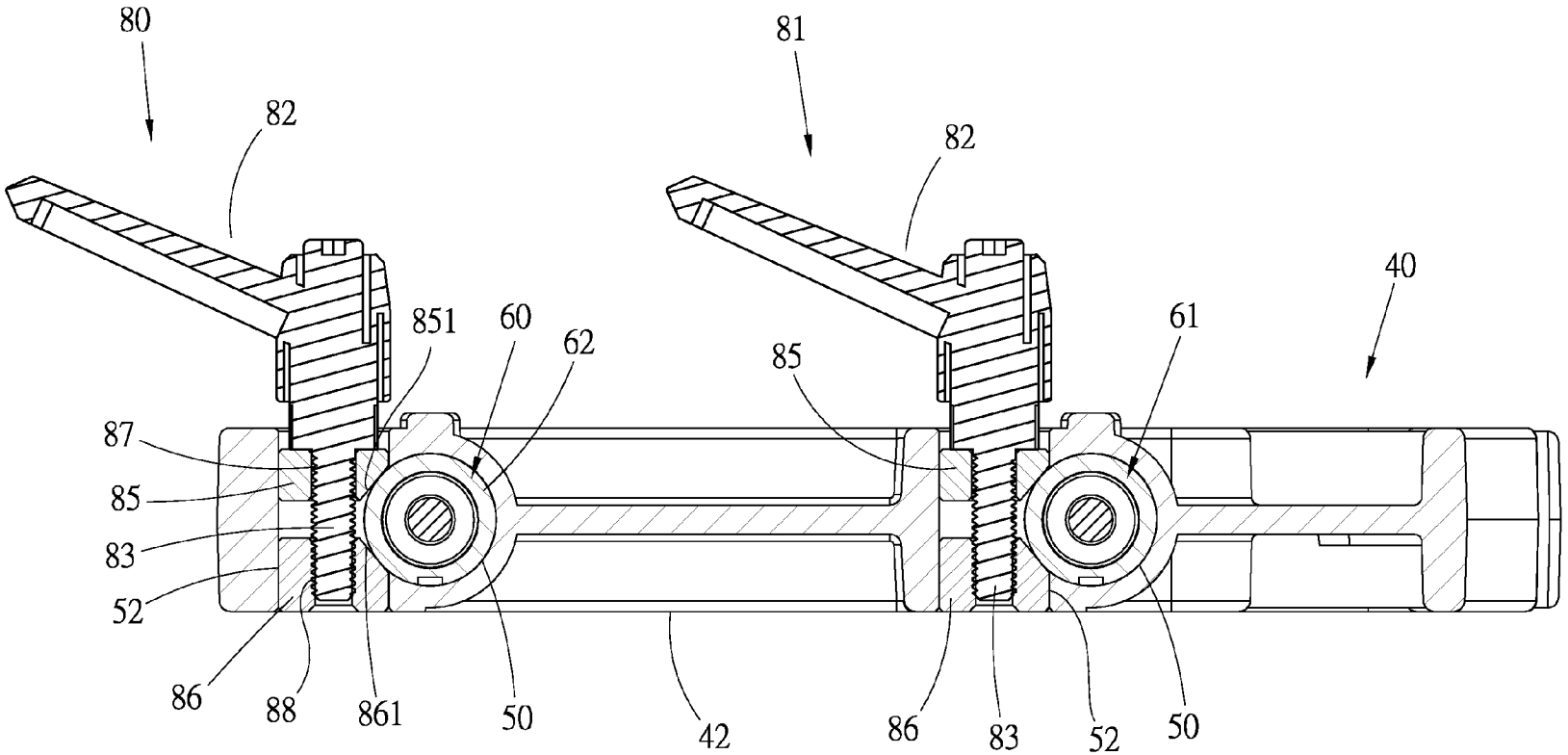
FIG. 5 is a sectional view taken along line 5-5 of FIG. 2.

The top arm 42 of the base 40 is formed with two vertical through holes 50 passing through the top arm 42 from a top face of the top arm 42 to a bottom face thereof. In addition, the top arm 42 is formed with two transverse installation holes 52 passing through the top arm 42 between two sides thereof corresponding to the two through holes 50 respectively. Referring to FIG. 5, one side of the installation hole 52 intersects one side of the corresponding through hole 50 in communication therewith.

Figure 6:
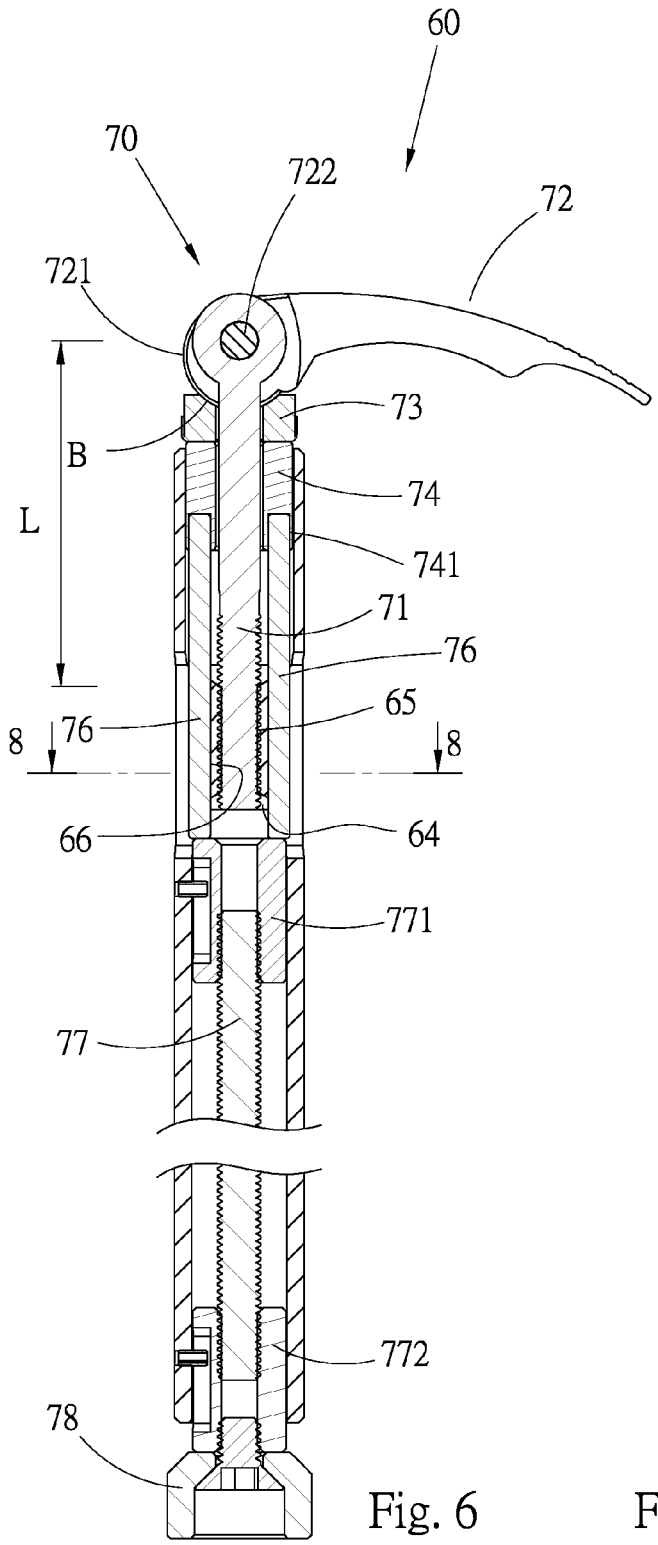
FIG. 6 is a longitudinally sectional view of the press rod of the preferred embodiment of the present invention.
Figure 7:
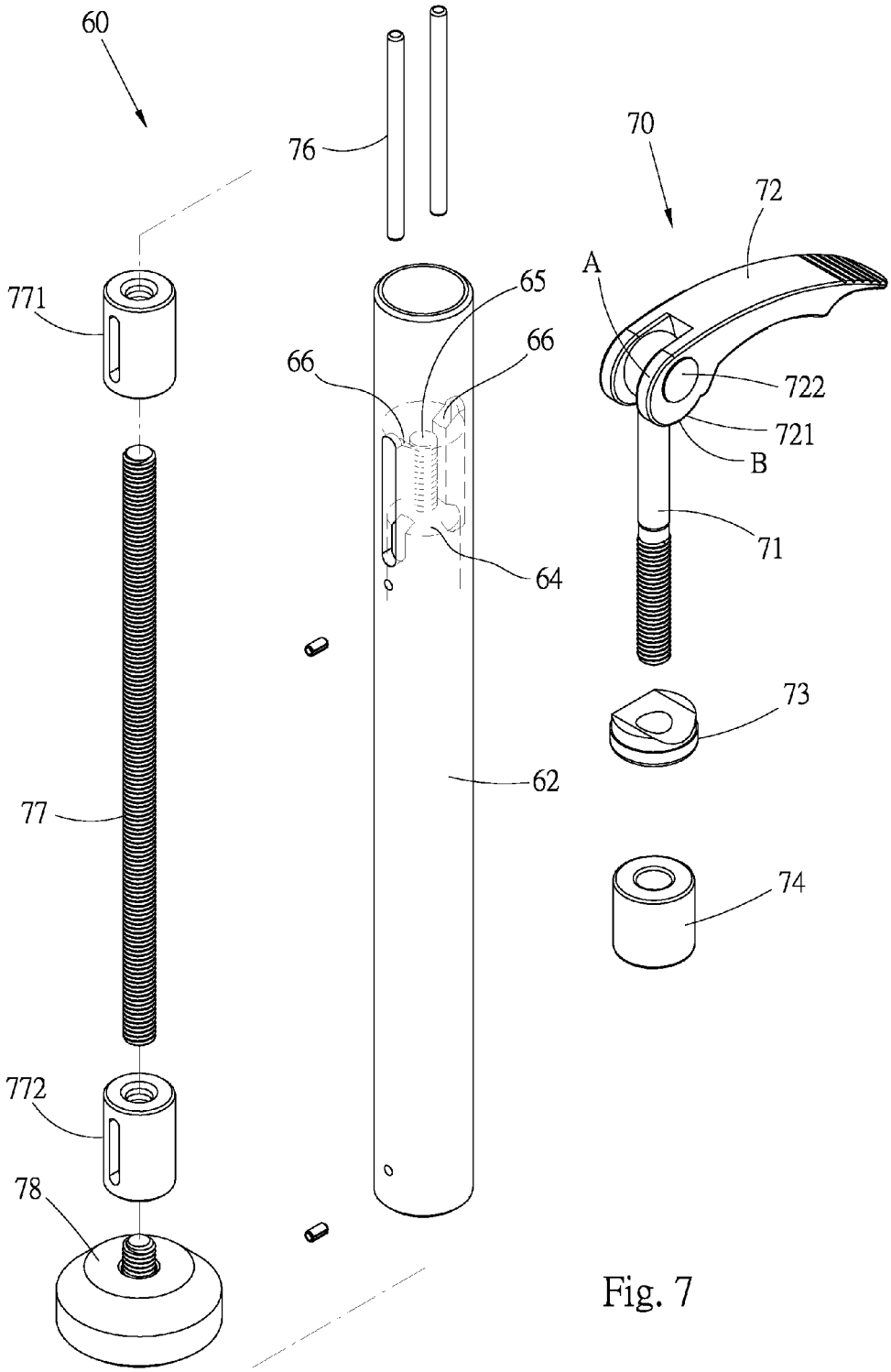
FIG. 7 is a perspective exploded view of the press rod of the preferred embodiment of the present invention.
Figure 8:
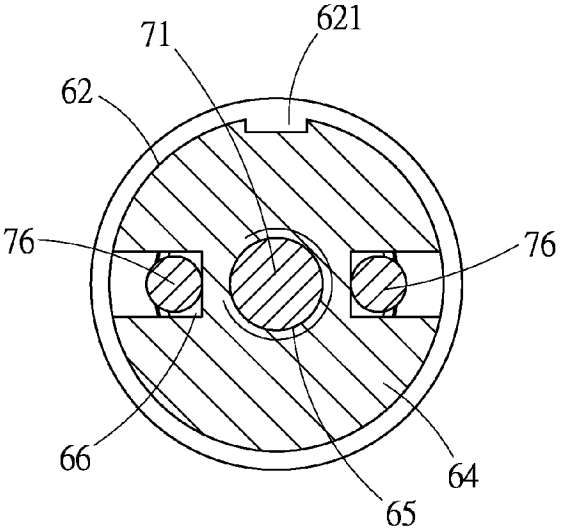
FIG. 8 is a sectional view taken along line 8-8 of FIG. 6.
Figure 10:
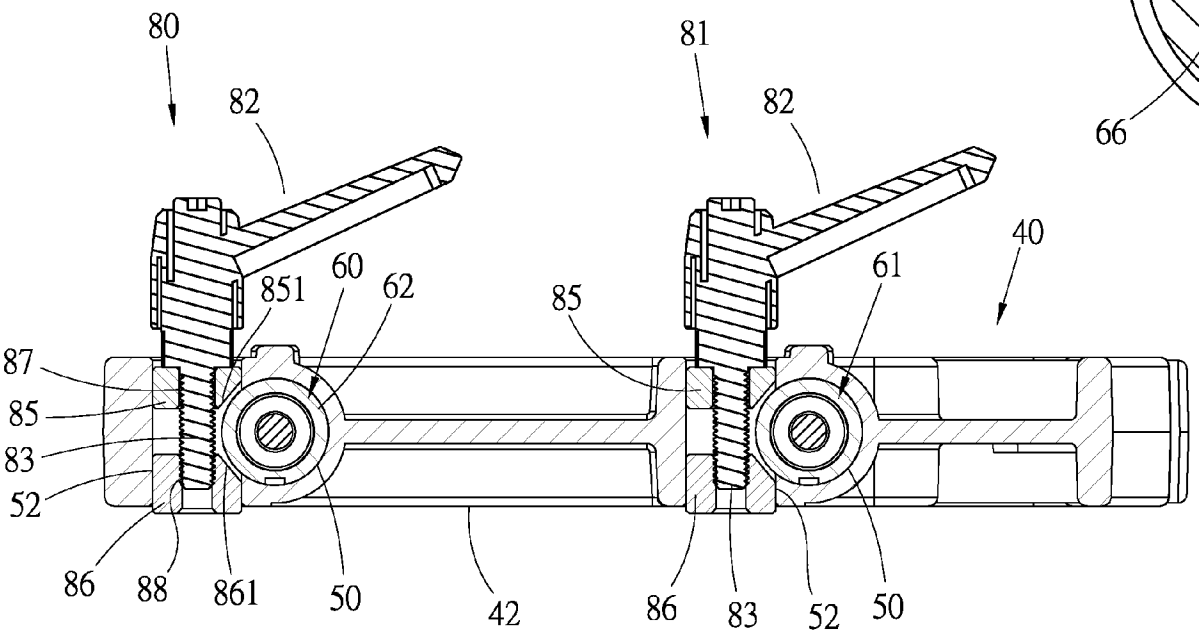
FIG. 10 is a sectional view showing that the press rods are released from the fastener assemblies of the preferred embodiment of the present invention.

The first and second press rods 60, 61 are identical to each other in structure. The first press rod 60 is taken as an example for illustration. The same components are denoted with the same reference numerals. Referring to FIGS. 6 to 8, the press rod 60 has an outer tube 62, which can be a circular tube or polygonal tube. The outer tube 62 has a solid section 64 disposed in the outer tube 62. The solid section 64 is formed with a threaded hole 65 in an axial direction of the outer tube 62. The solid section 64 is further formed with two passages 66, which pass through the solid section 64 in the axial direction of the outer tube 62. Preferably, the threaded hole 65 is located at the center of the outer tube 62 and is positioned between the passages 66.

Figure 9:
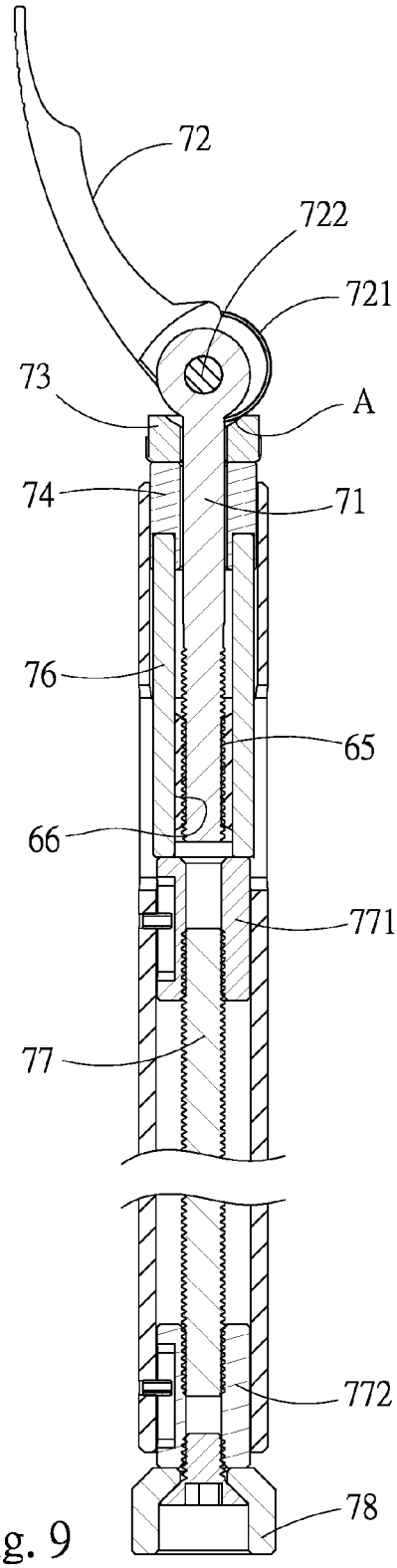
FIG. 9 is a longitudinally sectional view of the press rod of the preferred embodiment of the present invention, showing that the press rod is positioned in a releasing position.

A cam mechanism 70 and a link assembly 75 are disposed in the outer tube 62. The cam mechanism 70 includes a threaded rod 71 and a cam lever 72. A front end of the cam lever 72 has a cam section 721 pivotally connected with a top end of the threaded rod 71 via a pivot shaft 722. A bottom end of the threaded rod 71 extends from a top end of the outer tube 62 into the outer tube 62 and is screwed in the threaded hole 65. The cam lever 72 is positioned outside the top end of the outer tube 62 and manually operable. The cam section 721 has a circumference spaced from the pivot shaft 722 by different distances at different parts. That is, part A of the cam section 721 has a minimum camber and is spaced from the pivot shaft 722 by a minimum distance. Accordingly, when the cam lever 72 is lifted to a releasing position as shown in FIG. 9, the link assembly 75 is released from the pressing force of the cam lever 72. Part B of the cam section 721 has a maximum camber and is spaced from the pivot shaft 722 by a larger distance. Accordingly, when the cam lever 72 is shifted to a pressing position as shown in FIG. 6, the link assembly 75 is driven to move within the outer tube 62. A flexible pad block 73 and a cylindrical transmission member 74 are fitted on the threaded rod in contact with the cam section 721.

The link assembly 75 is mounted in the outer tube 62 and movable along the outer tube 62. When shifting the cam lever 72, the link assembly 75 is driven to move within the outer tube 62. To speak more specifically, the link assembly 75 includes two actuation rods 76, a link 77, an upper collar 771 and a lower collar 772. The two actuation rods 76 are respectively fitted in the passages 66 and slidable within the passages 66. Top ends of the actuation rods 76 extend out of the passages to abut against a bottom end of the transmission member 74. In practice, the bottom end face of the transmission member 74 is formed with two sockets 741 for plugging the top ends of the two connecting into the sockets 741. The link 77 is a threaded rod having a top end and a bottom end. The upper and lower collars 771, 772 are respectively screwed on the top end and the bottom end of the link 77. Bottom ends of the actuation rods 76 also extend out of the passages to contact with the upper collar 771. A clamp head 78 is screwed in the lower collar 772 and positioned outside a bottom end of the outer tube 62. It should be noted that the actuation rods 76, the link 77 and the collars 771, 772 can be alternatively made as a one-piece rod body to achieve the same effect.

Referring to FIG. 6, the solid section 64 serves as a support section for the cam mechanism 70. On the basis of the top end of the threaded hole 65, the support section is spaced from the pivot shaft 722 by a length L. In the case that no board material is clamped with the press rod 60, the threaded rod 71 can be rotated to adjust the depth at which the threaded rod 71 extends into the outer tube, that is, adjust the length L, so that the distance between the outer tube 62 and the clamp head 78 that protrudes from the outer tube 62 can be adjusted.

The two press rods 60, 61 are respectively up and down movably installed in the through holes 50 of the base 40. The second press rod 61 is closer to the upright arm 44 of the base 40. Referring to FIG. 3, a longitudinal channel 621 is formed on an outer circumference of the outer tube 62. A pin (not shown) is embedded in the top arm 42 of the base 40 and inlaid in the channel 621, whereby the press rod can only up and down move within the through hole without rotating.

Referring to FIGS. 3 and 5, the two first fastener assemblies 80, 81 are identical to each other in structure and are respectively installed in the installation holes 52 of the base 40. The fastener assembly 80 is taken as an example for illustration hereinafter. The fastener assembly 80 has a knob 82 and two clamping blocks 85, 86. The clamping blocks 85, 86 have a configuration, such as circular shape or polygonal shape, adapted to that of the installation hole 52. The clamping blocks 85, 86 are movably mounted in the installation hole 52. Each of the clamping blocks 85, 86 is formed with a threaded hole 87, 88 passing through the clamping block from one end face to the other end face. The threads of the threaded holes 87, 88 have reverse spiral directions. In addition, the opposite sides of the two clamping blocks 85, 86 are respectively formed with two oblique clamping faces 851, 861, which can be plane faces or arcuate faces. The clamping faces 851, 861 respectively contact with two sides of the circumference of the outer tube 62. The knob 82 has a threaded rod section 83 screwed in the threaded holes 87, 88 of the clamping blocks 85, 86. When the knob 82 is rotated in a direction, for example, clockwise, the clamping blocks 85, 86 are moved toward each other into tight abutment with the circumference of the outer tube 62. Under such circumstance, the clamping blocks 85, 86 and the inner wall of the through hole 50 form a three-point holding mechanism for tightly holding the press rod 60. When the knob 82 is rotated in another direction, for example, counterclockwise, the clamping blocks 85, 86 are moved away from each other to release the press rod 60. Accordingly, only by means of rotating the knob 82 of the fastener assembly 80 within a range of half a circle, the press rod can be securely fastened or released. The clamping blocks 85, 86 can be copper-made, and they are able to clamp the outer tube 62 without damaging the same.

Figure 11:
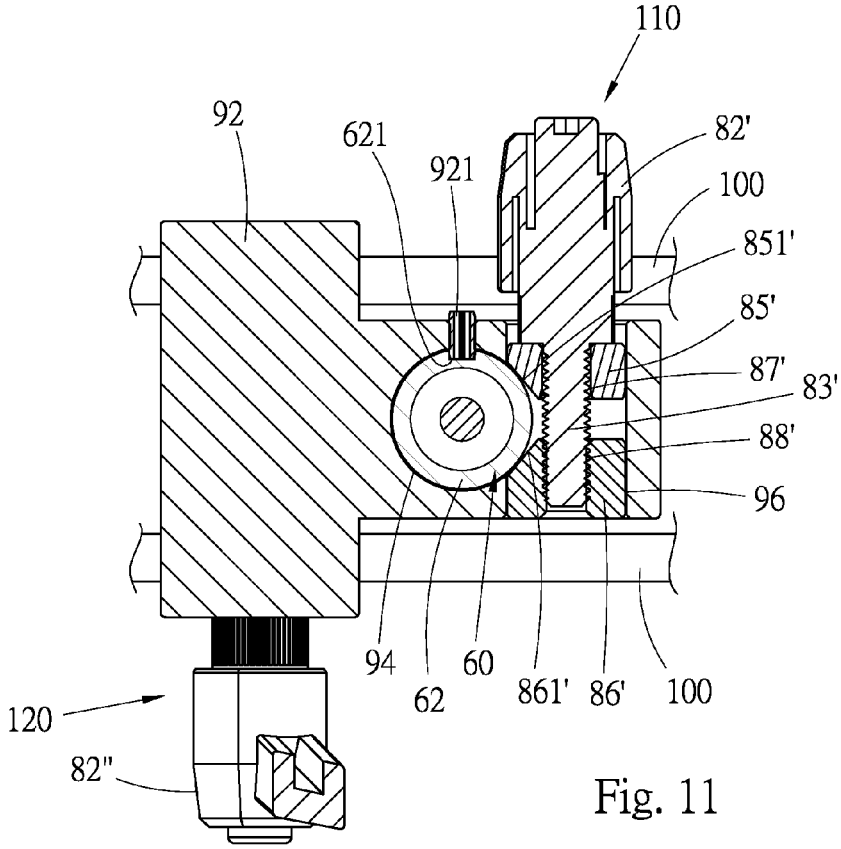
FIG. 11 is a sectional view taken along line 11-11 of FIG. 2.
Figure 13:
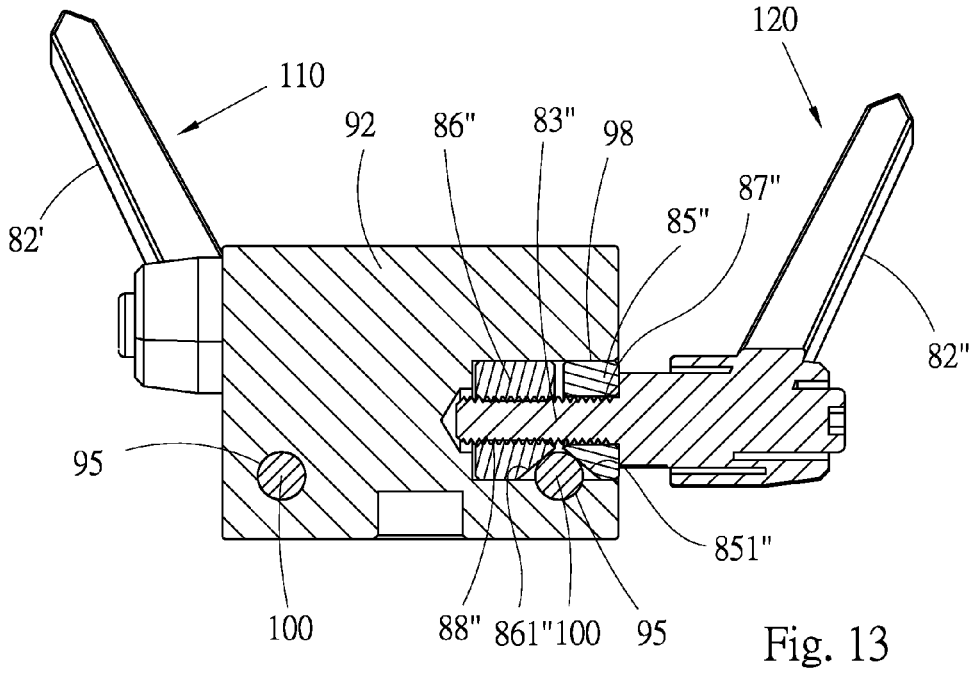
FIG. 13 is a sectional view taken along line 13-13 of FIG. 3.
Figure 12:
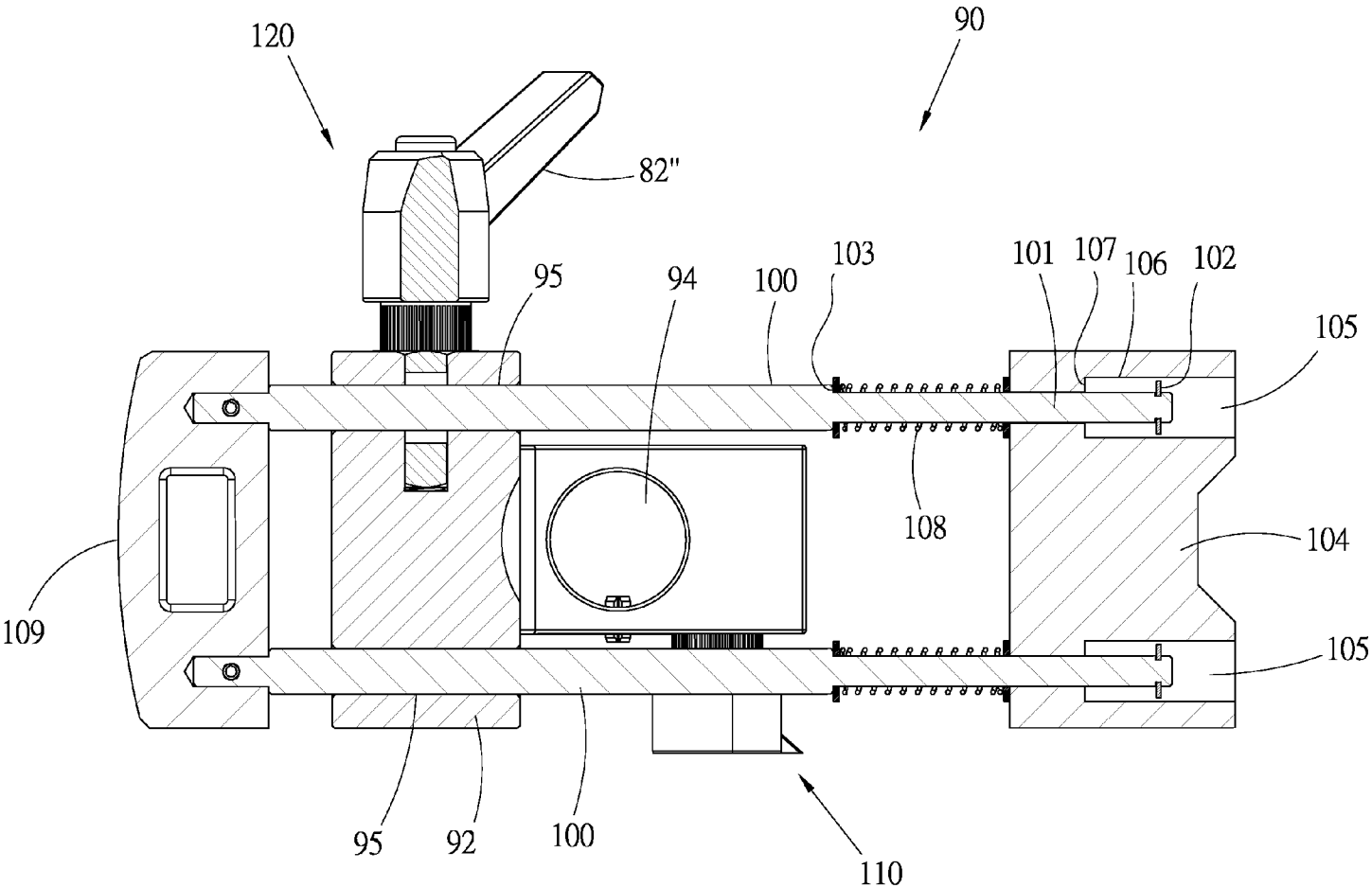
FIG. 12 is a bottom sectional view taken along line 12-12 of FIG. 3.

Referring to FIGS. 11 to 13, the horizontal holder mechanism 90 includes a slide seat 92 formed with a second through hole 94 passing through the slide seat from a top face of the slide seat to a bottom face thereof. The slide seat 92 is further formed with two guide holes 95 passing through the slide seat from a front end face of the slide seat to a rear end face thereof in parallel to each other. The slide seat 92 is further formed with a second installation hole 96 and a third installation hole 98, which pass through the slide seat 92 between two sides thereof. One side of the second installation hole 96 intersects one side of the second through hole 94 as shown in FIG. 11. One side of the third installation hole 98 intersects one side of one guide hole 95 as shown in FIG. 13. Two guide pins 100 are slidably fitted in the guide holes 95 of the slide seat 92 as shown in FIG. 12. Each of the guide pins 100 has a front end formed with a small-diameter section 101. A front end of the small-diameter section 101 is provided with a stopper flange 102 such as a C-shaped retainer. A shoulder 103 is formed at a rear end of the small-diameter section 101 of the guide pin 100. The holder mechanism 90 further has an abutment member 104 formed with two stepped holes 105 passing through the abutment member 104 from a front end face of the abutment member 104 to a rear end face thereof. The small-diameter sections 101 of the guide pins 100 respectively extend into the stepped holes 105 of the abutment member 104, whereby the abutment member 104 is movable along the guide pins 100. Each of the stepped holes 105 has a large-diameter section 106 and a shoulder 107 at a rear end of the large-diameter section 106. The stopper flanges 102 of the guide pins 100 are positioned in the large-diameter sections 106 of the stepped holes 105. The shoulders 107 of the stepped holes 105 serve to stop the stopper flanges 102 of the guide pins and prevent the abutment member 104 from detaching from the guide pins. Two resilient members 108, which are springs, are respectively fitted around the small-diameter sections 101 of the guide pins. First ends of the resilient members 108 abut against the abutment member, while second ends of the resilient members 108 abut against the shoulders 103 of the guide pins 100. The resilient members 108 normally push the abutment member 104 forward to the front ends of the guide pins and make the front ends of the guide pins positioned in the stepped holes of the abutment member. A grip 109 is fixedly connected to the rear ends of the guide pins 100.

The first press rod 60 is fitted in the through hole 94 of the slide seat 92, whereby the holding mechanism 90 can be slid along the press rod 60. The abutment member 104 is directed to the upright arm 44 of the base 40. A pin member 921 is embedded in the slide seat 92 and inlaid in the longitudinal channel 621 of the press rod to prevent the slide seat from rotating as shown in FIG. 11.

Referring to FIG. 11, the second fastener assembly 110 is identical to the first fastener assembly 80 in structure. The same components are denoted with the same reference numerals. The clamping blocks 85', 86' of the fastener assembly 110 are installed in the second installation hole 96 of the slide seat 92. The threaded rod section 83' of the knob 82' is screwed in the threaded holes 87', 88' of the clamping blocks 85', 86'. The threads of the threaded holes 87', 88' have reverse spiral directions. When the knob 82' of the second fastener assembly 110 is rotated in a direction, the clamping blocks 85', 86' are moved toward each other. At this time, the clamping faces 851', 861' tightly abut against the outer circumference of the first press rod 60. Under such circumstance, the clamping blocks 85', 86' and the inner wall of the through hole 94 form a three-point holding mechanism for securely fastening the horizontal holder mechanism 90 to the first press rod 60. When the knob 82' of the second fastener assembly 110 is rotated in another direction, the clamping blocks 85', 86' are moved away from each other to release the press rod 60. At this time, the holder mechanism 90 is unfastened from the press rod.

The third fastener assembly 120 is also identical to the first fastener assembly 80 in structure. The same components are denoted with the same reference numerals. The clamping blocks 85", 86" of the fastener assembly 120 are installed in the third installation hole 98 of the slide seat 92. When the knob 82" of the third fastener assembly 120 is rotated in a direction, the clamping blocks 85", 86" are moved toward each other into tight abutment with the outer circumference of the guide pin 100. Under such circumstance, the guide pin 100 is held by a three-point holding mechanism and prevented from moving. When the knob 82" of the third fastener assembly 120 is rotated in another direction, the clamping blocks 85", 86" are moved away from each other to release the guide pin 100, the guide pins and the abutment member 104 can be moved.

Figure 14:
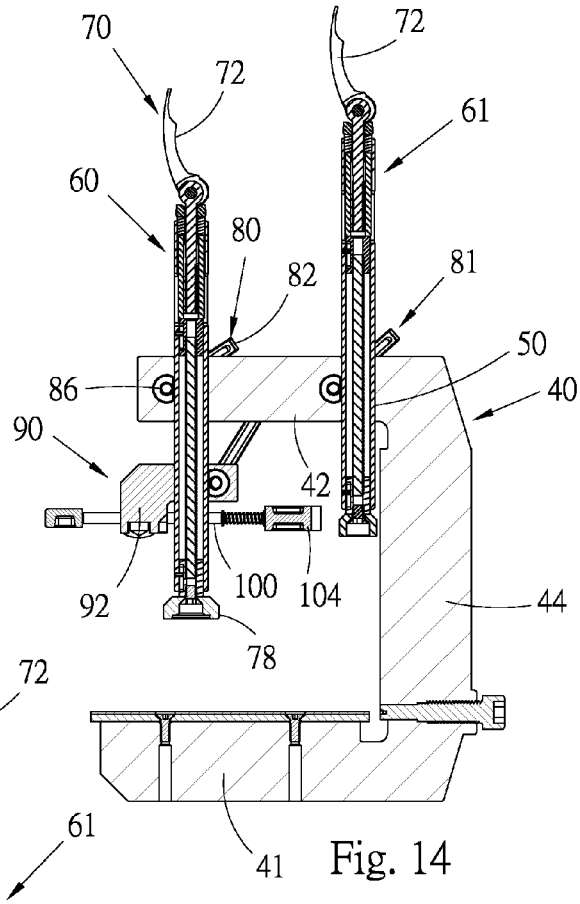
FIGS. 14, 15 and 16 show the operation of clamping the board materials.
Figure 15:
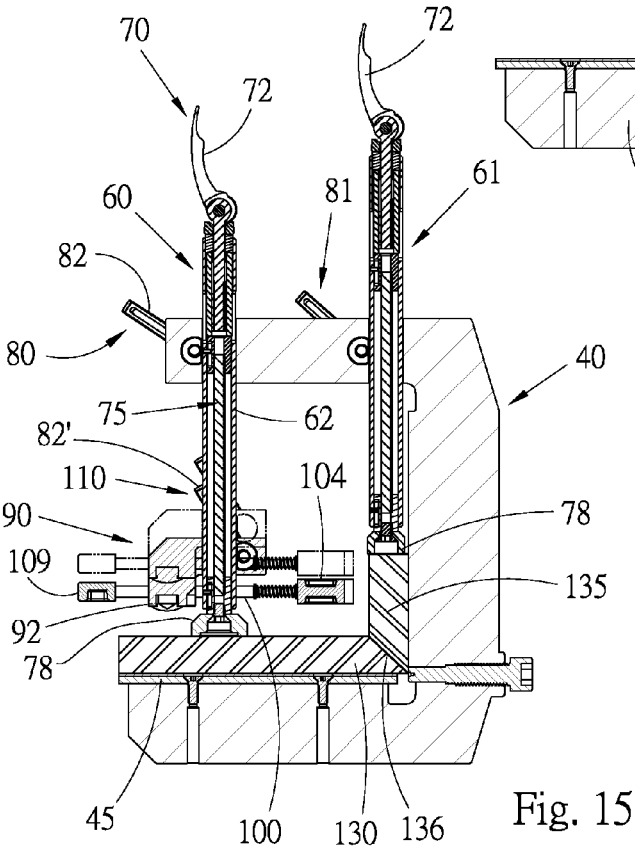

The clamping device 30 of the present invention is used to clamp and fix board materials. Please refer to FIG. 14. In use, the first fastener assemblies 80, 81 are first loosened to release the press rods 60, 61 and the cam levers 72 of the cam mechanisms 70 are lifted to the releasing position as shown in FIG. 9. Then a user can move the press rods 60, 61 upward and place a horizontal board material 130 and an upright board material 135 onto the base 40. An adhesive is applied to beveled sides 136 of the two board materials and then the beveled sides 136 are attached to each other. Thereafter, the press rods 60, 61 are lowered to make the bottom ends of the press rods contact with the board materials 130, 135 respectively as shown in FIG. 15. Then, the knobs 82 of the fastener assemblies 80, 81 are rotated to fasten the press rods 60, 61 with the fastener assemblies 80, 81 as shown in FIG. 5. At this time, the outer tubes 62 of the press rods are fixed.

Figure 16:
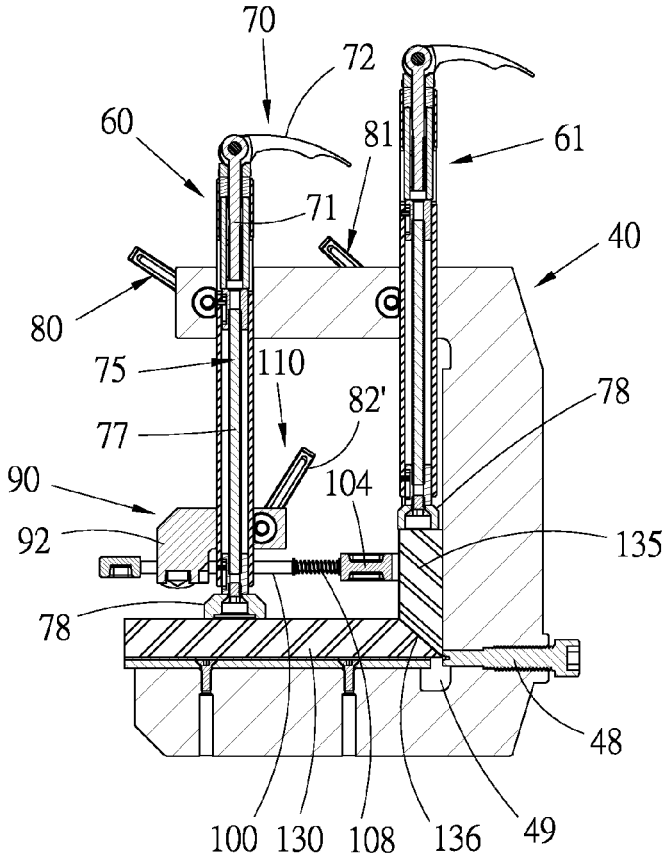

Taking the press rod 60 as an example, when the cam lever 72 is positioned in the releasing position as shown in FIG. 9, the cam section 721 provides a minimum camber, whereby there is an allowance for the link assembly 75 to move into the outer tube 62. Therefore, in the operation as shown in FIG. 15, when the bottom end of the press rod 60 touches the board material 130, the link assembly 75 is moved upward into the outer tube 62 by several millimeters. Then the cam lever 72 is shifted to the pressing position to clamp the board material 130 with the press rod 60 as shown in FIG. 16. Also referring to FIG. 6, since the outer tube 62 of the press rod 60 is fixed, therefore, when the cam lever 72 is shifted to the pressing position, the cam section 721 of the cam lever will travel downward to depress the transmission member 74. The transmission member 74 then pushes the actuation rods 76 and the link 77 to move downward, whereby the clamp head 78 is lowered to fasten the board material 130. In other words, simply by means of shifting the cam lever 72, the bottom end of the press rod 60 can truly exert a clamping force upon the horizontal board material 130 to securely clamp the same. Similarly, the second press rod 61 can be operated in the same manner to fixedly clamp the upright board material 135.

Afterwards, the user can loosen the second fastener assembly 110 to vertically move the horizontal holder mechanism 90 along the first press rod 60 as shown in FIG. 15. After the horizontal holder mechanism 90 is adjusted to a suitable height, the knob 82' of the second fastener assembly is rotated to fasten the holder mechanism 90 to the press rod 60 at the height. Finally, the guide pins 100 are moved to make the abutment member 104 abut against a face of the upright board material 135. Then the guide pin 100 is fastened with the third fastener assembly 120 to fix the guide pin and the abutment member 104. Under such circumstance, the holder mechanism 90 horizontally abuts against the board material 135 to enhance stability and ensure that the board material 135 is attached to the standard face 46.

The inner end 481 of the standard bolt 48 is flush with the standard face 36 for locating the board material 135. Moreover, in the case that the adhesive spills from the gap between the beveled sides 136 of the board materials, the adhesive will adhere to the inner end 481 of the bolt 48 without directly staining the base 40. After a period of time of clamping the two board materials, the adhesive will be hardened to adjoin the two board materials with each other by an angle of 90 degrees. At this time, the fastener assemblies 80, 81, 110, 120 can be loosened and the cam levers 72 can be shifted to the releasing position to remove the board materials.

According to the above arrangement, simply by means of rotating the knobs of the fastener assemblies and shifting the cam levers, the board materials can be quickly clamped or released. Such operation is easy and convenient to perform.

The horizontal holder mechanism can be adjusted to an optimal height to securely hold the upright board material.

The above embodiment is only used to illustrate the present invention, not intended to limit the scope thereof. Many modifications of the above embodiment can be made without departing from the spirit of the present invention.

What is claimed is:

1. A clamping device for adjoining board materials, comprising:

a C-shaped base having a horizontal base section, a top arm and an upright arm connected between the base section and the top arm; the top arm of the base being formed with two through holes passing through the top arm from a top face of the top arm to a bottom face thereof;

a first press rod and a second press rod, which are identical to each other in structure, the first and second press rods being respectively up and down movably installed in the two through holes of the base, the second press rod being closer to the upright arm of the base, each of the press rods having:

an outer tube having a solid section disposed in the outer tube, the solid section being formed with a threaded hole in an axial direction of the outer tube; at least one passage passing through the solid section in the axial direction of the outer tube;

a cam mechanism disposed in the outer tube, the cam mechanism including a threaded rod and a cam lever, a front end of the cam lever having a cam section pivotally connected with a top end of the threaded rod, a bottom end of the threaded rod extending from a top end of the outer tube into the outer tube and being screwed in the threaded hole of the solid section; the cam lever being positioned outside the top end of the outer tube and shiftable between a releasing position and a pressing position; and a link assembly mounted in the outer tube and movable along the outer tube, a top end of the link assembly extending through and out of the passage of the solid section, whereby when shifting the cam lever to the pressing position, the cam section pushes the link assembly to move toward a bottom end of the outer tube; a clamp head being connected with a bottom end of the link assembly and positioned outside the bottom end of the outer tube;

two first fastener assemblies respectively installed between the top arm of the base and the press rods, the two first fastener assemblies serving to clamp or release the outer tubes of the press rods;

a horizontal holder mechanism including: a slide seat formed with a second through hole passing through the slide seat from a top face of the slide seat to a bottom face thereof; the slide seat being further formed with at least one guide hole passing through the slide seat from a front end face of the slide seat to a rear end face thereof; at least one guide pin slidably fitted in the guide hole of the slide seat; and an abutment member disposed at a front end of the guide pin; the first press rod being fitted through the second through hole of the slide seat, whereby the holder mechanism is up and down movable within the base along the first press rod; the abutment member being directed to the upright arm of the base;

a second fastener assembly disposed between the slide seat and the first press rod for clamping or releasing the first press rod, whereby the holder mechanism can be secured to the first press rod; and a third fastener assembly disposed between the slide seat and the guide pin for clamping or releasing the guide pin.

2. The clamping device as claimed in claim 1, wherein the link assembly includes at least one actuation rod and a link; the actuation rod being fitted through the passage of the solid section; the link being positioned under the actuation rod, a top end of the link contacting with a bottom end of the actuation rod; the clamp head being connected with a bottom end of the link; the cam lever serving to push a top end of the actuation rod, the actuation rod then pushing the link to move the clamp head.

3. The clamping device as claimed in claim 2, wherein an upper collar and a lower collar are respectively connected with the top end and the bottom end of the link, the upper collar contacting with the bottom end of the actuation rod; the clamp head being connected with the lower collar.

4. The clamping device as claimed in claim 3, the link is a threaded rod; the upper and lower collars are respectively screwed on the top end and the bottom end of the link.

5. The clamping device as claimed in claim 1, wherein a cylindrical transmission member is fitted around the threaded rod and positioned between the link assembly and the cam lever, whereby the cam lever can push the link assembly via the transmission member.

6. The clamping device as claimed in claim 2, wherein a cylindrical transmission member is fitted around the threaded rod and positioned between the link assembly and the cam lever, a bottom end of the transmission member contacts with a top end of the actuation rod, whereby the cam lever can push the link assembly via the transmission member.

7. The clamping device as claimed in claim 1, wherein the top arm of the base is further formed with two installation holes passing through the top arm between two sides thereof, each of the installation holes having one side that intersects one side of one of the through holes; the two first fastener assemblies being identical to each other in structure, each of the first fastener assemblies having a knob and two clamping blocks, the clamping blocks being movably mounted in one of the installation holes, each of the clamping blocks being formed with a threaded hole passing through the clamping block from one end face of the clamping block to the other end face thereof, the threads of the threaded holes of the two clamping blocks having reverse spiral directions; opposite sides of the two clamping blocks being respectively formed with two clamping faces for respectively contacting with two sides of outer circumference of the outer tube; the knob having a threaded rod section screwed in the threaded holes of the clamping blocks, whereby when rotating the knob, the clamping blocks are driven to move within the installation hole toward each other or away from each other for clamping or releasing the outer tube of the press rod.

8. The clamping device as claimed in claim 1, wherein the horizontal holder mechanism further has a second installation hole and a third installation hole, which pass through the slide seat between two sides thereof; one side of the second installation hole intersecting one side of the second through hole; one side of the third installation hole intersecting one side of the guide hole; the second fastener assembly and the third fastener assembly being identical to each other in structure, each of the second and third fastener assemblies having a knob and two clamping blocks, each of the clamping blocks being formed with a threaded hole passing through the clamping block from one end face of the clamping block to the other end face thereof; the threads of the threaded holes of the two clamping blocks having reverse spiral directions; opposite sides of the two clamping blocks being respectively formed with two clamping faces; the knob having a threaded rod section screwed in the threaded holes of the clamping blocks; the second fastener assembly being installed in the second installation hole, whereby when rotating the knob of the second fastener assembly, the clamping blocks are driven to make the clamping faces of the clamping blocks clamp or release the outer tube of the first press rod; the third fastener assembly being installed in the third installation hole, whereby when rotating the knob of the third fastener assembly, the clamping blocks are driven to make the clamping faces of the clamping blocks clamp or release the guide pin.

9. The clamping device as claimed in claim 7, wherein the horizontal holder mechanism further has a second installation hole and a third installation hole, which pass through the slide seat between two sides thereof; one side of the second installation hole intersecting one side of the second through hole; one side of the third installation hole intersecting one side of the guide hole; the second fastener assembly and the third fastener assembly being identical to each other in structure, each of the second and third fastener assemblies having a knob and two clamping blocks, each of the clamping blocks being formed with a threaded hole passing through the clamping block from one end face of the clamping block to the other end face thereof; the threads of the threaded holes of the two clamping blocks having reverse spiral directions; opposite sides of the two clamping blocks being respectively formed with two clamping faces; the knob having a threaded rod section screwed in the threaded holes of the clamping blocks; the second fastener assembly being installed in the second installation hole, whereby when rotating the knob of the second fastener assembly, the clamping blocks are driven to make the clamping faces of the clamping blocks clamp or release the outer tube of the first press rod; the third fastener assembly being installed in the third installation hole, whereby when rotating the knob of the third fastener assembly, the clamping blocks are driven to make the clamping faces of the clamping blocks clamp or release the guide pin.

10. The clamping device as claimed in claim 1, wherein the base further has a bottom board detachably mounted on a top face of the base section.

11. The clamping device as claimed in claim 1, wherein a threaded hole is formed through the upright arm of the base from an outer side of the upright arm to an inner side thereof, the threaded hole being positioned at a juncture between the upright arm and the base section; a standard bolt being screwed in the threaded hole with an inner end of the standard bolt extending to the inner side of the upright arm.

12. A clamping device for adjoining board materials, comprising:

a C-shaped base having a horizontal base section, a top arm and an upright arm connected between the base section and the top arm; the top arm of the base being formed with two through holes passing through the top arm from a top face of the top arm to a bottom face thereof;

a first press rod and a second press rod being respectively up and down movably installed in the two through holes of the base, the second press rod being closer to the upright arm of the base;

two first fastener assemblies respectively installed between the top arm of the base and the press rods, the two first fastener assemblies serving to clamp or release the outer tubes of the press rods respectively;

a horizontal holder mechanism including: a slide seat formed with a second through hole passing through the slide seat from a top face of the slide seat to a bottom face thereof; the slide seat being further formed with at least one guide hole passing through the slide seat from a front end face of the slide seat to a rear end face thereof; at least one guide pin slidably fitted in the guide hole of the slide seat, a front end of the guide pin being directed to the upright arm of the base; the first press rod being fitted through the second through hole of the slide seat, whereby the holder mechanism is up and down movable within the base along the first press rod;

a second fastener assembly disposed between the slide seat and the first press rod for clamping or releasing the first press rod, whereby the holder mechanism can be secured to the first press rod; and a third fastener assembly disposed between the slide seat and the guide pin for clamping or releasing the guide pin.

13. The clamping device as claimed in claim 12, wherein the horizontal holder mechanism comprises an abutment member, the abutment member is disposed at a front end of the guide pin.

14. The clamping device as claimed in claim 13, wherein a front end of the guide pin extends into the abutment member, whereby the abutment member is slidable relative to the guide pin; at least one resilient member being disposed between the guide pin and the abutment member for resiliently pushing the abutment member outward.

15. The clamping device as claimed in claim 13, wherein the slide seat is formed with two guide holes in parallel to each other; two guide pins being respectively fitted in the guide holes, each of the guide pins having a front end formed with a small-diameter section; a stopper flange being disposed at a front end of the small-diameter section; the abutment member being formed with two stepped holes in parallel to each other, each of the stepped holes having a large-diameter section and a shoulder at a rear end of the large-diameter section; the small-diameter sections of the guide pins extending into the stepped holes of the abutment member, the stopper flanges of the small-diameter sections of the guide pins being positioned in the large-diameter sections of the stepped holes; two resilient members being respectively fitted around the guide pins, first ends of the resilient members abutting against the abutment member, while second ends of the resilient members abutting against the shoulders of the guide pins; a grip being connected to the rear ends of the guide pins.

16. The clamping device as claimed in claim 12, wherein the horizontal holder mechanism further has a second installation hole and a third installation hole, which pass through the slide seat between two sides thereof; one side of the second installation hole intersecting one side of the second through hole; one side of the third installation hole intersecting one side of the guide hole; the second fastener assembly and the third fastener assembly being identical to each other in structure, each of the second and third fastener assemblies having a knob and two clamping blocks, each of the clamping blocks being formed with a threaded hole passing through the clamping block from one end face of the clamping block to the other end face thereof; the threads of the threaded holes of the two clamping blocks having reverse spiral directions; opposite sides of the two clamping blocks being respectively formed with two clamping faces; the knob having a threaded rod section screwed in the threaded holes of the clamping blocks; the second fastener assembly being installed in the second installation hole, whereby when rotating the knob of the second fastener assembly, the clamping blocks are driven to make the clamping faces of the clamping blocks clamp or release the outer tube of the first press rod; the third fastener assembly being installed in the third installation hole, whereby when rotating the knob of the third fastener assembly, the clamping blocks are driven to make the clamping faces of the clamping blocks clamp or release the guide pin.

17. The clamping device as claimed in claim 12, wherein the top arm of the base is further formed with two installation holes passing through the top arm between two sides thereof, each of the installation holes having one side that intersects one side of one of the through holes; the two first fastener assemblies being identical to each other in structure, each of the first fastener assemblies having a knob and two clamping blocks, the clamping blocks being movably mounted in one of the installation holes, each of the clamping blocks being formed with a threaded hole passing through the clamping block from one end face of the clamping block to the other end face thereof, the threads of the threaded holes of the two clamping blocks having reverse spiral directions; opposite sides of the two clamping blocks being respectively formed with two clamping faces for respectively contacting with two sides of outer circumference of the outer tube; the knob having a threaded rod section screwed in the threaded holes of the clamping blocks, whereby when rotating the knob, the clamping blocks are driven to move within the installation hole toward each other or away from each other for clamping or releasing the outer tube of the press rod.

18. The clamping device as claimed in claim 12, wherein the base further has a bottom board detachably mounted on a top face of the base section.

19. The clamping device as claimed in claim 12, wherein a threaded hole is formed through the upright arm of the base from an outer side of the upright arm to an inner side thereof, the threaded hole being positioned at a juncture between the upright arm and the base section; a standard bolt being screwed in the threaded hole with an inner end of the standard bolt extending to the inner side of the upright arm.

* * * * *